United States Patent [19]

Jorgensen

[11] Patent Number: 4,685,663

[45] Date of Patent: Aug. 11, 1987

[54] PRECISION VISE WITH INDEPENDENTLY MOVEABLE JAWS

[76] Inventor: Peter B. Jorgensen, 61 Marty Ct., Newbury Park, Calif. 91320

[21] Appl. No.: 841,863

[22] Filed: Mar. 20, 1986

[51] Int. Cl.[4] ..... B25B 1/10

[52] U.S. Cl. ..... 269/244

[58] Field of Search ..... 269/244, 245, 242, 221-223, 269/133, 136, 138, 43, 45

[56] References Cited

U.S. PATENT DOCUMENTS

| | | | |
|---|---|---|---|
| 671,921 | 4/1901 | McGehee | 269/242 |
| 2,370,042 | 2/1945 | Jesionowski . | |
| 3,397,880 | 5/1968 | Kuban . | |
| 3,861,664 | 1/1975 | Durkee | 269/906 |
| 3,883,128 | 5/1975 | Breese | 269/45 |
| 3,977,662 | 8/1976 | Cook | 269/244 |
| 4,098,500 | 7/1978 | Lenz . | |
| 4,205,833 | 6/1980 | Lenz . | |
| 4,223,879 | 9/1980 | Wolfe et al. . | |
| 4,299,377 | 11/1981 | Lenz . | |
| 4,341,375 | 7/1982 | Romanin | 269/906 |
| 4,413,818 | 11/1983 | Lenz . | |
| 4,413,819 | 11/1983 | Lenz . | |
| 4,448,406 | 5/1984 | Hallberg et al. . | |
| 4,496,139 | 1/1985 | Lenz . | |
| 4,529,183 | 7/1985 | Krason et al. . | |

OTHER PUBLICATIONS

Kurt Manufacturing Company, Anglock Precision Machine Vice (1979).

Chick Bi-Lok Machine Company, Bi-Lok Vise.

*Primary Examiner*—Robert C. Watson

*Attorney, Agent, or Firm*—Koppel & Harris

[57] ABSTRACT

A dual vise is disclosed which has first and second vise assemblies. The vise assemblies have centrally fixed stationary jaws and independently controlled moveable jaws, each vise assembly being capable of holding a work piece under a pressure which is independent of the holding pressure for the other vise assembly, The pressure for each vise assembly is under the control of the operator. The moveable jaws are preferably controlled by concentric lead screw shafts. When used in conjunction with numerical control equipment, productivity is increased and damage to individual work pieces is reduced.

5 Claims, 7 Drawing Figures

PRECISION VISE WITH INDEPENDENTLY MOVEABLE JAWS

BACKGROUND OF THE INVENTION

1. Field of the Invention

This invention relates to an apparatus used to hold work pieces for machining and, more specifically, to a vise capable of holding two work pieces.

2. Description of the Prior Art

Numerical control equipment are devices which perform functions automatically upon computer-given instructions. A single tool is able to perform a function and to move automatically among several work pieces that are secured to the work table of the device. The only function that is performed manually is securing the raw stock to the work table and removing the pieces upon completion of the machine's operations.

The operation of machining materials using numerically controlled equipment is much more expedient and efficient if more than one work piece, either raw stock or a partially finished piece, is available to the numerically controlled equipment at one time. Various dual vises are available which are capable of holding two work pieces. Whether the two pieces are at the same stage of production or at different stages, the ability to hold two pieces with one vise reduces the time needed to set up before an operation is performed by the numerically controlled equipment.

A number of vises capable of holding two work pieces have been manufactured, with varying degrees of success. In U.S. Pat. No. 4,448,406, the moveable jaws are simultaneously driven in opposed reciprocation by a single shaft, the pressure exerted on both work pieces being the same.

In U.S. Pat. No. 4,341,375 a vise was designed for clamping a pair of snow skis. The vise uses a single shaft and is capable of clamping two skis of different widths. After the first ski is secured by the first vise assembly in a spring-tight position, continued rotation of the shaft causes pressure to be exerted on the second ski in the second vise assembly. After both skis are held spring-tight, further shaft rotation tightens each one equally. The operator is unable to apply varied pressures to the skis held in each vise assembly, and material of a delicate nature placed in the first vise assembly may be damaged by excessive force. A further problem with this design is that a ski held in the first vise assembly may slip from its original position while the second ski is being secured in the second vise assembly.

Other improvements have been made to dual vises. The dual vise in U.S. Pat. No. 4,529,183 is capable of holding delicate material in both vise assemblies while holding the shaft in tension. The pressure exerted on each work piece in the vise assembly is equal. The operator has no option to differ the amount of pressure exerted on each work piece.

While a work piece is being worked upon it needs to be securely held. However, the pressure should not be so excessive as to damage the finish of the work piece, or the work piece itself. A problem common to the prior art is an inability to hold two work pieces which may be at different stages of production without damaging the work piece at a more delicate stage, and yet to hold each work piece securely enough to avoid slippage.

SUMMARY OF THE INVENTION

In view of the above problems with the prior art, the object of the present invention is the provision of a novel and improved dual vise capable of holding two objects of different or similar size securely without damaging either piece.

A further object of the present invention is to provide a dual vise situated on a base, containing a plurality of moveable jaws which move independently of each other towards and away from stationary jaws, said components when taken together forming a vise assembly.

The preferred way of implementing this is a dual vise situated on a base and having two independently operated moveable jaws which operate against the opposing jaw plates of a common stationary jaw. First and second concentric shafts extend through the base and each independently engage respective moveable jaws to slide the moveable jaws relative to the stationary jaws in response to rotation of the shafts.

The independent control of the two moveable jaws permits the operator to tailor the level of pressure exerted on each piece to the particular need of that work piece, thus allowing the dual vise to securely hold the two work pieces. This eliminates slippage in the first work piece that may occur while pressure is being placed on the second work piece, and also eliminates possible damage done to the finish of the work piece or the work piece itself.

These and other features and objects of the invention will be apparent to those skilled in the art from the following detailed description of a preferred embodiment, taken together with the accompanying drawings, in which:

DETAILED DESCRIPTION OF THE PREFERRED EMBODIMENT

Figure 1:
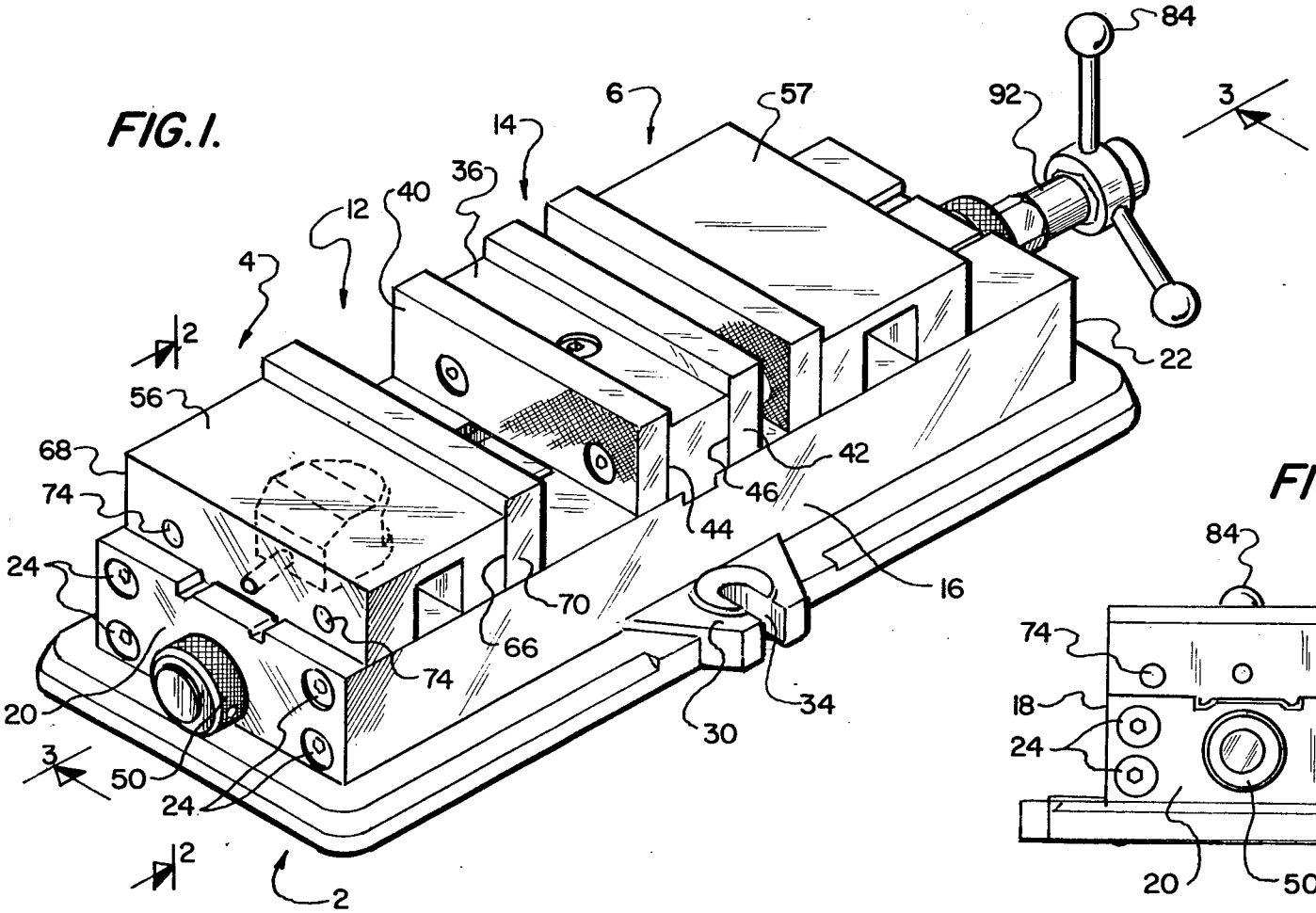
FIG. 1 is a perspective view of a dual vise incorporating the present invention.
Figure 2:
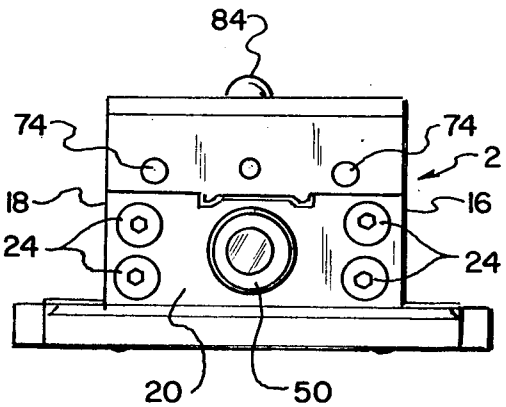
FIG. 2 is a left side elevational view of the dual vise.
Figure 3:
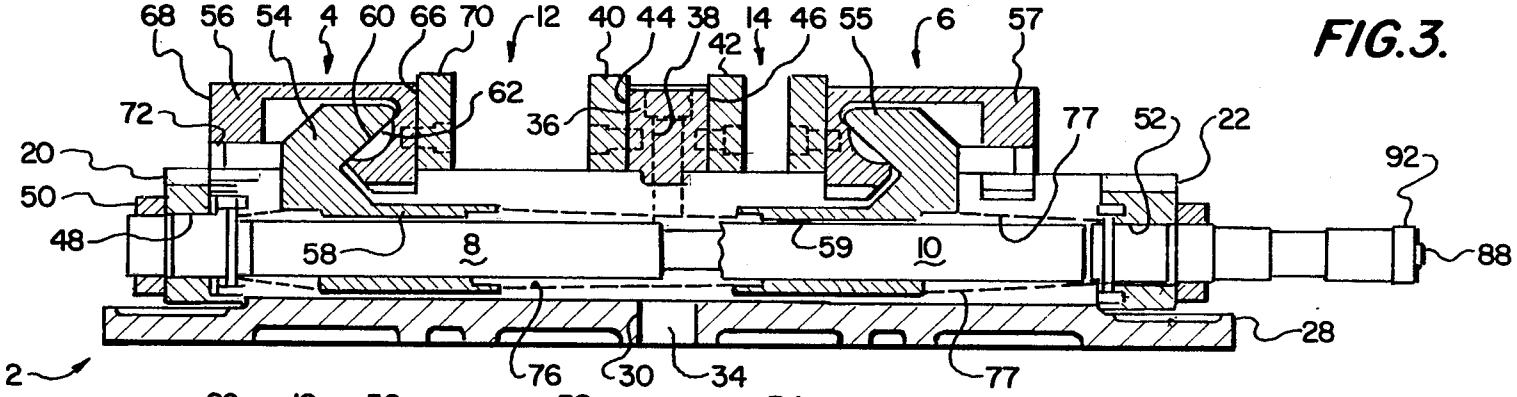
FIG. 3 is a sectional view taken along line 3—3 of FIG. 1.
Figure 4:
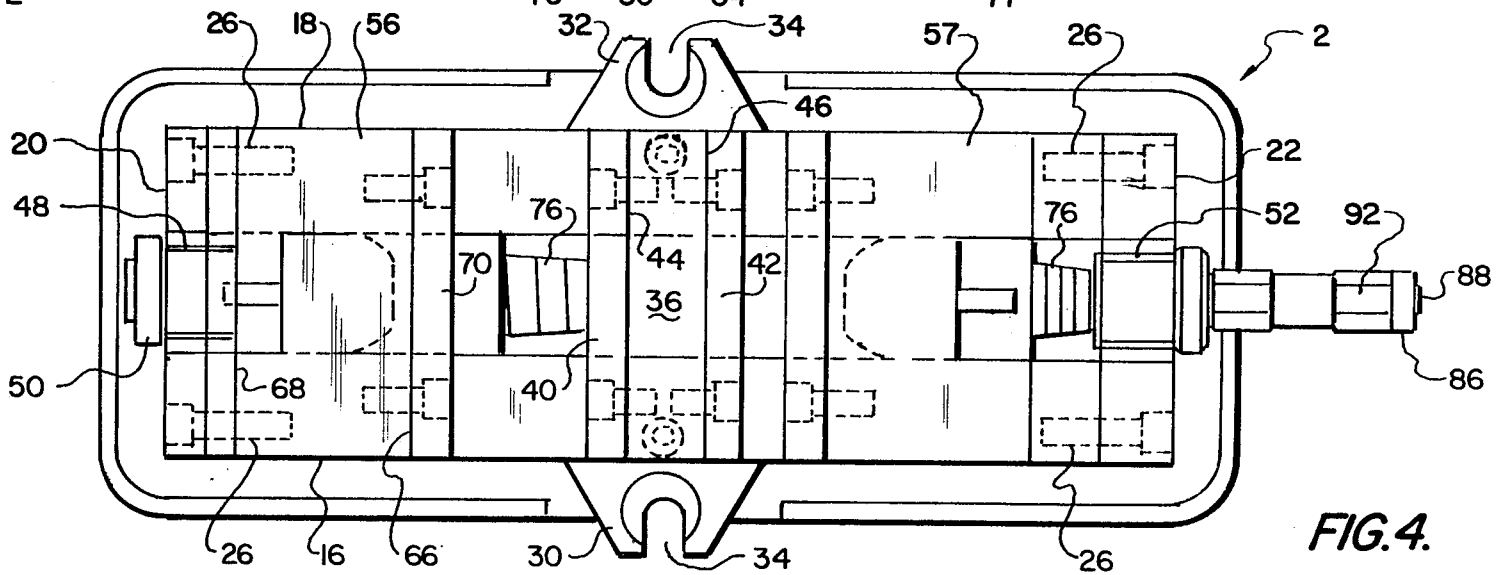
FIG. 4 is a top plan view of the dual vise.
Figure 5:
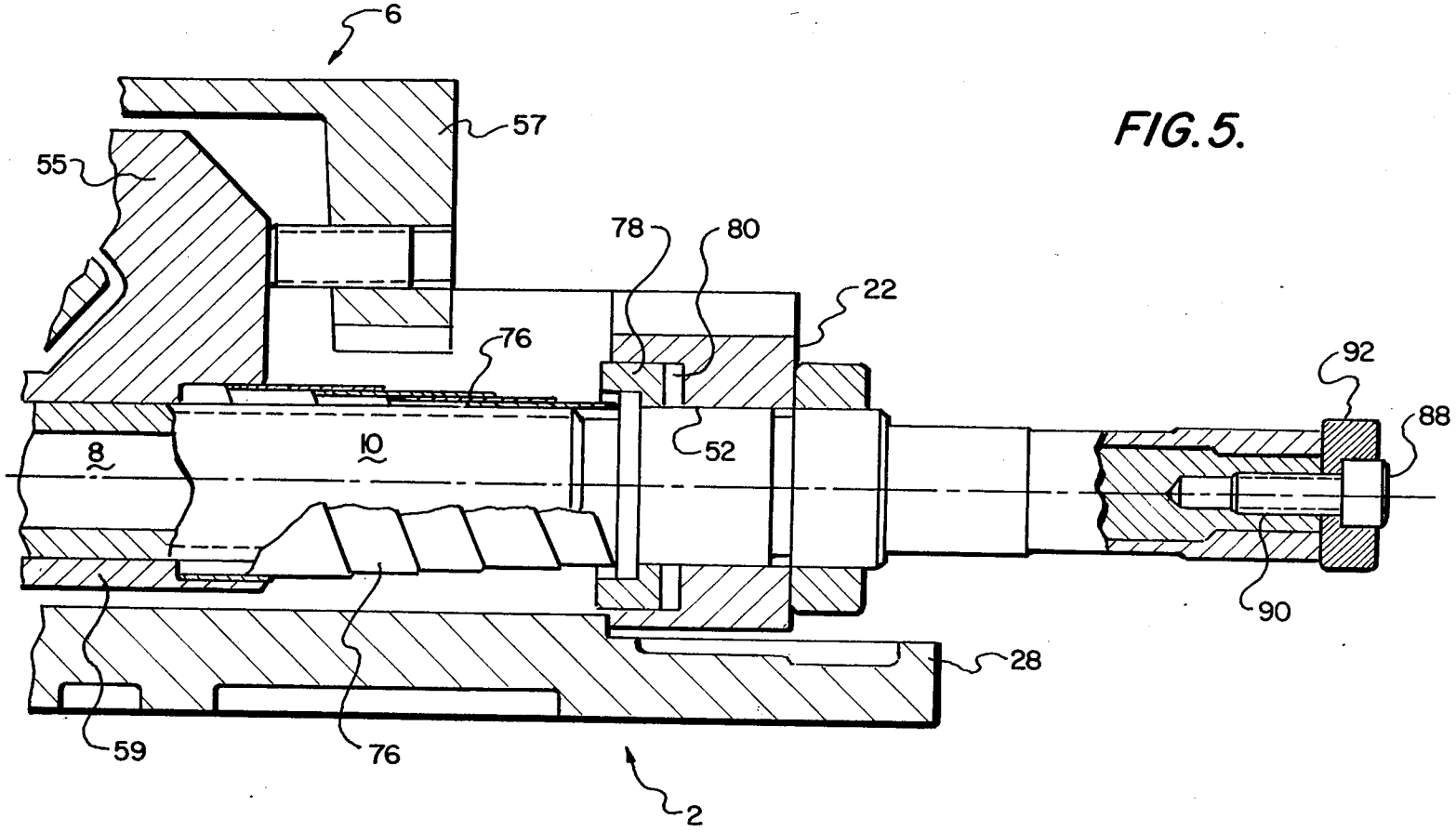
FIG. 5 is a fragmentary sectional view taken along line 5—5 of FIG. 1.
Figure 6:
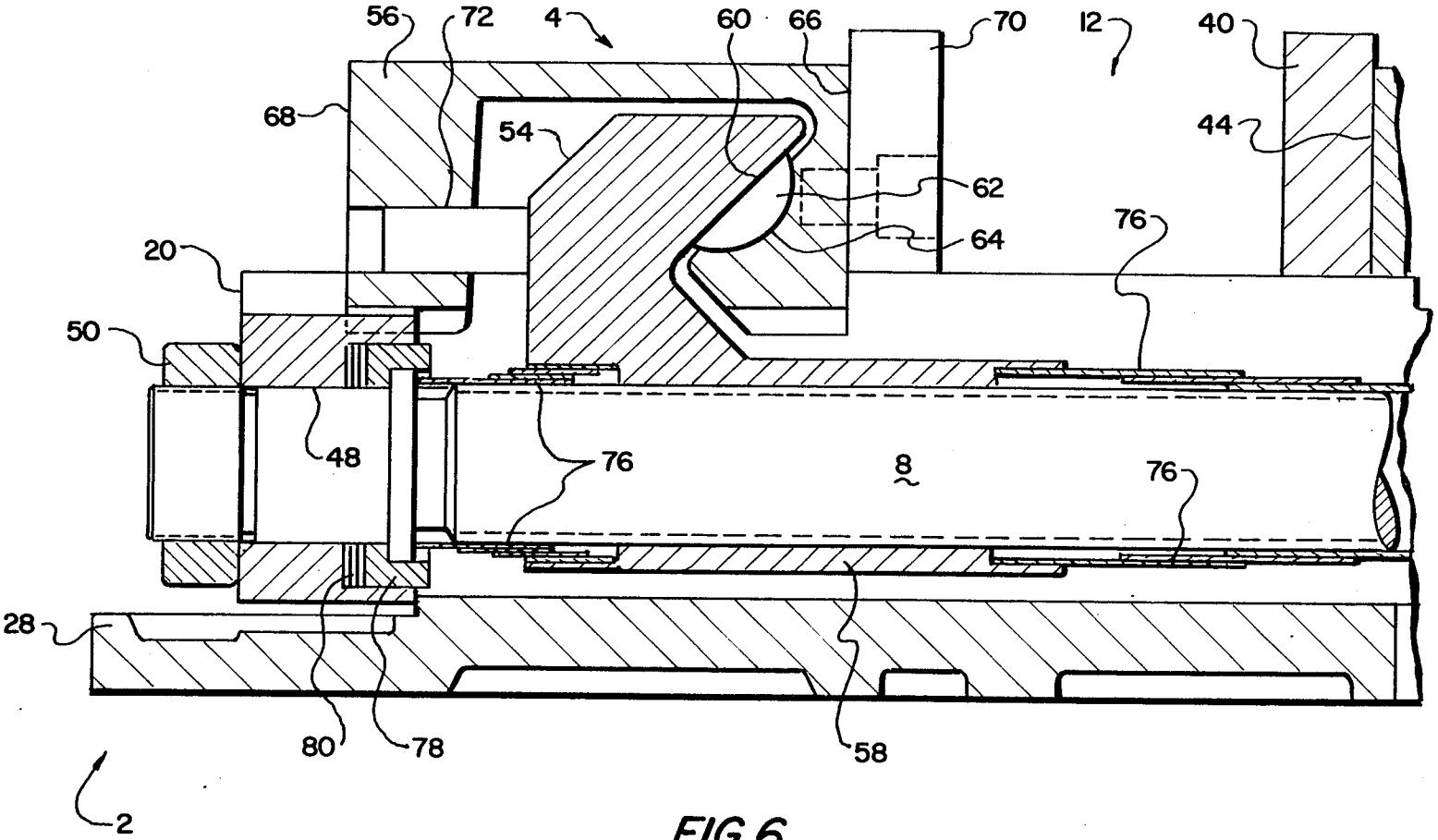
FIG. 6 is a fragmentary sectional view taken along line 6—6 of FIG. 1.
Figure 7:
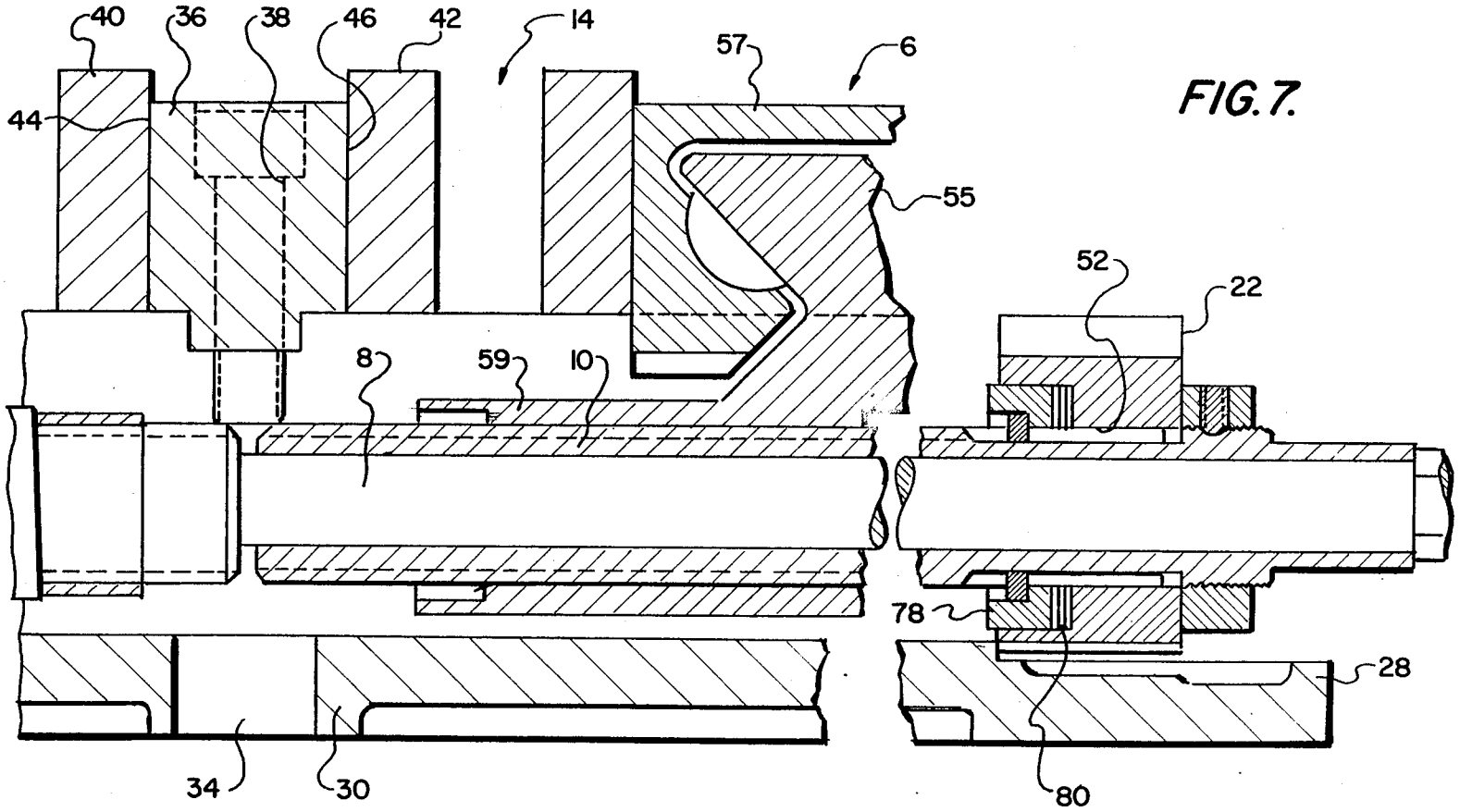
FIG. 7 is a fragmentary sectional view showing details of the concentric shafts.

The dual vise according to the invention contains a base 2 on which are situated two moveable jaws 4 and 6 and two stationary jaws, with two concentric shafts 8 and 10 extending through the base. The first shaft 8 engages the first moveable jaw 4 and moves it relative to the corresponding stationary jaw when the first shaft is rotated. In a like manner, the second shaft 10 engages the second moveable jaw 6 and moves it relative to the corresponding stationary jaw. Each pair of moveable and stationary jaws when taken together comprise respective vise assemblies 12 and 14.

The base 2 of the dual vise includes a front and rear rail 16 and 18, respectively. The transverse elevation is a slotted channel with the respective end plates 20 and 22 attached to each end of the rail by four screws 24 passing through horizontal bores 26 in each end plate and threaded bores in each rail. An upstanding margin 28 runs along the perimeter of the base creating a coolant trough. Ears 30 and 32 containing vertical bores 34 are located on each longitudinal side of the base, creating a means by which the vise may be accurately fixed in a position for use, such as within suitable numerically controlled machining equipment.

In the illustrated example of the present invention the stationary jaws are comprised of a centrally located block 36, which is keyed to the base 2 and held in place by two bolts passing through vertically bores 38 in the block 36 and threaded bores in the base. Jaw plates 40 and 42 are attached to the opposite faces 44 and 46 of the block.

Two concentric shafts are used to independently control the movement of the two moveable jaws 4 and 6. One is a solid inner shaft 8, and the other is a tubular outer shaft 10. The solid inner shaft 8 has two diameters, one larger than the other, with the diameter changing in the vicinity of the vertical centerline of the base 2. The larger diameter of shaft 8 is threaded and extends a short distance beyond the left end plate 20, through a horizontal bore 48 in the end plate. The extended portion is fitted with a threaded collar 50 which holds the shaft 8 in place.

The tubular shaft 20 runs concentrically with the solid shaft 8. The left end of the tubular shaft does not extend beyond the vertical centerline of the base. The tubular shaft is also threaded, with the threads preferably being opposite to those of shaft 8.

Both shafts 8 and 10 extend beyond the right end plate 22 of the base, passing through a horizontal bore 52 in the end plate, and are fitted with a threaded collar which holds the shafts in place.

The moveable jaws 4 and 6 comprise respective actuators 54 and 55 and jaw means 56 and 57. The actuators ride under the front and rear rails 16 and 18, respectively, at the point where the rails are slotted. The lower portions of the actuators 54 and 55 consist of collars 58 and 59, respectively. Each collar contains a horizontal threaded bore, the threaded bore of collar 58 engaging the threaded portion of shaft 8 and the threaded bore of collar 59 engaging the threaded portion of shaft 10.

The upper portion of actuator 54 contains a bearing surface 60, which forms a suitable angle with the horizontal plane of base 2. This bearing surface bears against a hemispherical segment 62 which is formed of hardened steel or a similar substance. The bearing surface 60 and the hemispherical segment comprise the area of the actuator that is in contact with the jaw means 56. The contact between jaw means 57 and actuator 55 is established in a similar conventional manner.

The jaw means 56 is coupled with the actuator 54. The jaw means slides over the top of the railings, holding the actuator up. The actuator 54 rides under the railings, pulling the jaw means down. This arrangement allows pressure to be exerted on the moveable jaw without allowing the moveable jaw to lift up from the rails 16 and 18.

The jaw means 56 includes a concavely hemispherical set 64 which is suitably angularly matched to the bearing surface 60 of the actuator. The jaw means has two faces 66 and 67 to which a jaw plate 70 can be attached. The face to which the jaw plate is attached is determined by the size of the work piece to be held. A horizontal threaded bore 72 in the jaw means allows a set screw 74 to pass through the jaw means and bear against an area of the actuator. The set screw may be adjusted to take up wear and to ensure adequate contact between the hemispherical segment 62 and the bearing surface 60.

The threading inside the collar 58 of the actuator 54 does not come into contact with the entire length of the shafts. Depending on the position of the actuator, several portions of the shaft are exposed. Surrounding these exposed portions are coiled springs 76 which protect the threadings of the collars 58 and 59 and the shafts 8 and 10 from metal chips and other foreign objects. The coiled springs are constructed from a thin flexible material that is wide enough to overlap the adjoining loops when in an expanded position, and is of such a diameter as to nest the adjacent loops when in a compressed position. The collars 58 and 59 are notched at each end to hold the coiled springs in place, causing the springs to move with the moveable jaws so as to continuously shield the exposed portion of the shaft.

At each end of the dual vise, just inside the end plates 20 and 22 the shafts are surrounded by shoulders 78 which serve as extensions of the shafts and effectively increase the cross-sectional area of the shafts at these points.

The shoulders 78 and the end plates 20,22 are separated by respective thrust bearings 80. The thrust bearings are comprised of a pressure bearing in between two thrust washers. The thrust bearings reduce friction, transfer the force from the shafts to the moveable jaws 4 and 6, and take up pressure allowing the vice assemblies to tighten.

As previously mentioned, both shafts 8 and 10 extend beyond the right end plate 22, the solid shaft 8 extending farther than the tubular shaft 10. Situated on each shaft is a shaped protuberance 82 onto which a handle 84 can be placed. In the example illustrated by FIG. 1 the right end of each shaft extending beyond the end plate 22 is cast in the shape of a hexagon. A hexagonal sleeve 92 with an inner dimension that accommodates the end of shaft 8. The outer dimension of the sleeve is equal to the hexagonal shape at the end of shaft 10. The sleeve is placed over shaft 8 making the diameters at the end of the shafts equal and allowing the opening in the handle to fit over the end of shaft 10 and the sleeve on shaft 8. The end of shaft 8 is fitted with an end cap 86 which is held in place by a screw 88 passing through a horizontal threaded bore 90. The end cap is used to ensure that the sleeve remains on the dual vise.

The design of the dual vise as disclosed in the invention allows the operator of the dual vise to vary the amount of pressure exerted on work pieces held by each vise assembly.

A work piece with a delicate finish may be placed in the first vise assembly, the vise assembly exerting the proper amount of pressure to securely hold the work piece without any slippage occurring. The first work piece can be securely held before any pressure has to be exerted by the second vise assembly. A piece of raw stock can then be placed in the second vise assembly, the vise assembly exerting the proper amount of pressure to avoid slippage during machining, without having any effect on the first vise assembly.

The pressure for each vise assembly is independent and under the control of the operator, allowing the vise to tailor the amount of pressure exerted to the needs of each particular piece.

An apparatus for a dual vise with independently operated vise grips has thus been shown and described which is highly effective. As numerous modifications and alternate embodiments of the invention will occur to those skilled in the art, it is intended that the invention be limited only in terms of the appended claims.

I claim:

1. A dual vise for holding one or more work pieces, each work piece being precisely located with respect to a fixed reference location, comprising:

a base;

first and second stationary jaws mounted on the base;

first and second moveable jaws mounted on the base;

first and second concentric shafts adapted to rotate independent of each other and extending through the base;

the moveable jaws being capable of moving independent of each other in response to rotation of their corresponding shafts, the first shaft engaging the first moveable jaw and moving said jaw relative to the first stationary jaw when the first shaft is rotated, and the second shaft engaging the second jaw and moving said jaw relative to the second stationary jaw when the second shaft is rotated, the moveable jaws and corresponding stationary jaws forming respective first and second vise assemblies, each vise assembly being capable of gripping or releasing a work piece placed therein; and means for controlling the rotation of each shaft independent of the other shaft, and thereby operating the first and second vise assemblies independent of each other.

2. A dual vise as defined in claim 1, wherein the stationary jaws are formed by a centrally located block fixed to the base with first and second jaw plates mounted on opposed faces of the block for respectively engaging the first and second moveable jaws.

3. A dual vise as defined in claim 1, wherein the first and second shafts have opposite threading directions which cause both vise assemblies to close when their respective shafts are rotated in one common direction and both vise assemblies to open when their respective shafts are rotated in the opposite direction, and are coupled to the moveable jaws in lead screw fashion by complementary threading.

4. A dual vise, for holding one or more work pieces, each work piece being precisely located with respect to a fixed reference location, comprising:

a base;

first and second stationary jaws mounted on the base;

first and second moveable jaws mounted on the base;

first and second concentric shafts extending through the base, each shaft extending beyond the base and including respective shaped protuberances, the protuberances being of substantially similar shapes and dimensions and adapted to receive a common handle for rotating the shafts, the shafts between the protuberances enabling the handle to slide from one protuberance to the other;

the moveable jaws being independently operable in response to rotation of their corresponding shafts, the first shaft engaging the first moveable jaw and moving said jaw relative to the first stationary jaw when the first shaft is rotated, and the second shaft engaging the second jaw and moving said jaw relative to the second stationary jaw when the second shaft is rotated, the moveable jaws and corresponding stationary jaws forming respective first and second vise assemblies capable of gripping or releasing work pieces therein; and means for independently controlling the rotation of the first and second shafts, and thereby independently operating the first and second vise assemblies.

5. A dual vise handle as defined in claim 4, further comprising a handle which is slideable between the two protuberances, and means for capturing the dual vise handle on the shafts.

* * * * *